United States Patent [19]

Schweickardt

[11] Patent Number: 4,677,348

[45] Date of Patent: Jun. 30, 1987

[54] COMBINED IGNITOR AND TRANSIENT SUPPRESSOR FOR GASEOUS DISCHARGE LIGHTING EQUIPMENT

[75] Inventor: Karl W. Schweickardt, San Antonio, Tex.

[73] Assignee: Starter Systems, Inc., Tempe, Ariz.

[21] Appl. No.: 728,704

[22] Filed: Apr. 29, 1985

[51] Int. Cl.[4] ..... H05B 37/03; H05B 41/00

[52] U.S. Cl. ..... 315/307; 315/289; 315/276; 336/219

[58] Field of Search ..... 315/240, 289, 242, 141, 315/276, 307; 336/219; 363/133

[56] References Cited

U.S. PATENT DOCUMENTS

| | | | |
|---|---|---|---|
| 3,675,077 | 7/1972 | Minks | 315/240 |
| 3,763,396 | 10/1973 | Shilling | 315/307 |
| 4,296,358 | 10/1981 | Bernier | 315/240 |
| 4,327,349 | 4/1982 | Ettinger et al. | 336/219 |
| 4,334,254 | 6/1982 | Baker et al. | 363/133 |
| 4,403,173 | 9/1983 | Mayer | 315/289 |
| 4,461,982 | 7/1984 | Fähnrich | 315/289 |
| 4,527,098 | 7/1985 | Owen | 315/289 |

*Primary Examiner*—Leo H. Boudreau
*Assistant Examiner*—Theodore Salindong
*Attorney, Agent, or Firm*—LaValle D. Ptak

[57] ABSTRACT

A circuit for the efficient generation of high voltage pulses for the initiation of conduction in gaseous discharge lamps, the effective suppression of potentially harmful voltage surges resulting from derangement of one or more electrical, current-carrying mechanical, or mechanical components within the overall gaseous discharge lighting apparatus, and reduction of radio frequency interference resulting from the normal and deranged operation of the overall gaseous discharge lighting apparatus. The ignitor/suppressor includes a semiconductor switching device, a capacitor of special characteristics, a transformer of special construction, and a resistor for the generation of high voltage pulses. The ignitor/suppressor also includes a semiconductor switching device, a capacitor of special characteristics, and a resistor for the effective suppression of abnormally high voltages. The circuit configuration of the ignitor/suppressor eliminates any corona-discharge induced insulation damage within the ballasting apparatus normally employed with gaseous discharge lamps. Features of its construction eliminate any corona-induced insulation damage within the ignitor/suppressor itself.

14 Claims, 13 Drawing Figures

COMBINED IGNITOR AND TRANSIENT SUPPRESSOR FOR GASEOUS DISCHARGE LIGHTING EQUIPMENT

BACKGROUND OF THE INVENTION

1. Field of the Invention

This invention relates to electrical apparatus and more particularly to devices normally employed as part of a gaseous discharge lighting system, wherein this invention generates voltage pulses which are required and suppresses voltage surges which are potentially destructive.

2. Description of the Prior Art

A gaseous discharge lamp operates in conjunction with a ballast circuit of one or another form for the purposes of maintaining proper operation of the lamp. It is characteristic of these lamps that a voltage significantly in excess of the normal operating voltage of the lamp is required in order to initiate electrical conduction through the gaseous volume of the lamp. It is also characteristic of these lamps that once conduction has been initiated, a means must be provided to limit the current through the lamp, without which current-limiting means, commonly referred to as a ballast, the lamp itself and associated equipment would be destroyed.

Gaseous discharge lamps are normally intended to be operated from common alternating current power sources. The ballasting apparatus typically consists of various combinations of inductors, capacitors, and transformers, all of which are configured so as to maintain conduction through the lamp while limiting the current to that required for proper operation of the lamp. Since gaseous discharge lamps require a starting voltage in excess of their normal operating voltage, an auxiliary circuit, commonly referred to as an ignitor or starter is incorporated into the ballasting apparatus, frequently taking the form of one or more taps on an inductor or transformer and some means of electrically pulsing this circuit such that high voltage pulses are applied to the lamp terminals for the purpose of meeting the lamp's starting voltage requirements. Once conduction through the lamp has been initiated by the high voltage pulses, the normal operating currents and voltages required for proper operation of the lamp are maintained by the other ballasting components. These other ballasting components typically consist of various combinations of inductors, transformers, resistors, and capacitors. For various practical reasons, the ballast-lamp circuit is usually an inductive circuit; that is, the current through the lamp is primarily controlled by the inductance of the circuit. Any capacitors incorporated into the ballast serve to modify the voltage-current phase relationship presented to the power source and/or to modify the voltage-current waveforms presented to the lamp.

It is characteristic of the ignition pulses generated by ignitor circuits that the pulses exhibit short rise time to high voltages. As a consequence of utilizing a portion of the associated ballasting equipment as a transformer for generating these quickly rising high voltages, corona discharges are initiated within, between, and on the surfaces of electrical insulating materials used in the construction of the associated ballasting equipment.

This corona discharge has two serious effects which significantly reduce the operational life of the overall gaseous discharge lighting system, as well as aggravates and intensifies both conduction and radiated RFI emissions, and significantly increases the cost of fabrication and utilization of the gaseous discharge lighting equipment.

The first effect is simply the power demand imposed by the corona discharge itself. It has been found that in a typical gaseous discharge lighting apparatus, two-thirds of the energy available from the ignitor circuit is consumed by the corona discharge, the remaining energy from the ignitor circuit being available to satisfy the energy losses of the ignitor circuit itself and the starting requirements of the gaseous discharge lamp.

These losses require the ignitor circuit to be much larger and more powerful than would be required to merely start conduction in the lamp, as well as significantly increasing the stresses upon the components of the ignitor circuit.

The second effect of the corona discharge is that it destroys the insulation of the ballasting apparatus and its associated wiring. This severely limits the useful lifetime of the gaseous discharge lighting system, as well as significantly increases the material costs associated with the system in the attempt to provide increased life by merely using materials of high voltage ratings.

The presence of inductive components in the discharge lamp circuit, through which the normal operating currents of the lamp flow, allow the generation of extraordinarily large voltage surges as a consequence of failure of the lamp or electrical connections in the lamp circuit. It is characteristic that a short circuit is of no consequence. The normal operation of a gaseous discharge lamp requires the ballasting apparatus to be designed to operate into a short. They are all designed to do this. The same ballasting apparatus, however, utilizes inductive components to control the flow of current through the lamp. Various component failures in the gaseous discharge lamp, its socket, associated wiring, etc. will cause the rapid interruption of this current flow.

This rapid interruption of current flow in the lamp and ballast circuit causes very large voltage surges of the form $E=L\ di/dt$, where E is the voltage units of volts, L is the circuit inductance in units of henries, and di/dt is the rate of change of the current, in units of amperes for i and units of seconds for t. As an example, if a current of one ampere is flowing in a circuit which contains one henry of inductance and this current is interrupted in a time of one microsecond, a voltage of one million volts will be generated, this voltage rising at the rate of one trillion volts per second and obviously in excess of what can be withstood safely and/or without damage by any practicable system of insulation.

A further consequence of these circuit interrupting type failures is they frequently are of a rectifying nature; that is, they have the nature of an electrical diode. This phenomenon is called a rectifying arc. This causes large direct current ("DC") voltages to build up within the capacitors frequently employed in the ballasting apparatus, which are designed and rated for alternating current ("AC") operation and in any case incapable of withstanding the large DC voltages which typically appear, particularly since these abnormal DC voltages coexist with and add to the normal AC voltages impressed upon the capacitor or capacitors of the ballasting apparatus resulting in failure of the capacitors from overvoltage.

Another consequence of the rectifying arcs is that they cause the magnetic materials used in the construction of the inductive portions of the ballasting apparatus to saturate. When this happens, the inductance is no longer capable of controlling or limiting the current through the lamp or itself and the current thus increases to large values only limited by incidental resistances in the circuit. This phenomenon is also self-accelerating in that a slightly rectifying arc will tend to saturate the inductance in such a manner that the resultant abnormal current flow not only intensifies the arc, it becomes even more of a rectifier or diode, leading to a more intense and more rectifying arc, and so on until the ballast inductor and lamp are both destroyed.

Many types of gaseous discharge lamps incorporate in their construction an outer envelope inside of which is placed the inner envelope within which the gaseous conduction itself takes place. For principally thermal reasons, the interstitial space between the inner and outer envelopes is typically evacuated to a high degree, that is, contains a vacuum. Electrical connections between the inner envelope's electrodes and the electrical lead wires which penetrate the outer envelope are typically made by a spot-welding or crimping operation. Due to the high operating temperatures and temperature cycling normally associated with the inner envelope and its electrodes, these spot-welded or crimped connections frequently become loose, thus opening the circuit and cutting off the flow of current in the circuit formed by the gaseous discharge lamp and the inductive ballasting components. Since these connections exist within the vacuum space of the outer envelope, this interruption of current flow occurs almost instantaneously, in accordance with the operating characteristics of the well-known high vacuum hard-contact switch. This rapid current-flow interruption, due to the typical inductance of the ballast, generates extremely high voltages in accordance with the $E=L\ di/dt$ relationship. These interruptions also tend to occur repeatedly and rapidly due to the small gap typically present in between the surfaces of the failed connection within the vacuum envelope.

Ballasting circuits which utilize a portion of an inductive component as a transformer also invariably couple significant amounts of radio frequency type energy back into AC power lines used as a source of power for the lighting equipment. This coupled energy and the corona discharge are the major sources of the notorious conducted and radiated radio frequency interference ("RFI") associated with gaseous discharge lighting equipment. Traditional ignitor and ballasting circuit configurations preclude the use of any practicable insulation, transient suppression, or RFI suppression.

As a result of all the above, gaseous discharge lighting installations today suffer from high failure rates, unnecessarily expensive construction, and generate unacceptable levels of radio frequency interference.

Therefore, the features of the prsent invention efficiently generate high voltage starter pulses, without inducing any corona discharge in itself or in the associated ballasting equipment or its wiring, effectively prevent the occurrence of destructive voltage surges due to derangement of the associated gaseous discharge lamp and/or its electrical current-carrying hardware, and permit the suppression of any radio frequency interference by the simple application of well-known inexpensive shielded wiring techniques.

SUMMARY OF THE INVENTION

The preferred embodiment of the invention is a thick-film hybrid circuit constructed as is common practice with this manufacturing technique with a transformer of special construction, all encapsulated within the volume of a specially compounded electrically insulating and thermally conductive material. Suitable terminals are provided for connection to the ballasting equipment and to the lamp. The resulting combined ignitor and suppressor module is further overcoated with a metallic coating, said metallic coating being applied by chemical, electrochemical, photochemical, evaporative condensation, or mechanical techniques and subsequently blackened to optimize its heat dissipating properties. The metallic coating serves to confine all dielectric stresses to within the volume of the specially compounded electrically insulating and thermally conductive material. The modular package design provides for enhanced thermal dissipation as well as permits electrically shielded connections to be made to both the ballast and to the lamp associated with its use, for the purpose of meeting regulatory requirement for conduction and/or radiated radio frequency interference. The intimacy of the bond between the metallic overcoating eliminates any voids of any sort between the metallic overcoating and the bulk of the encapsulation material. This intimate and void-free bond causes all electrical stresses to be supported by the volume of the encapsulation material, eliminating any undue concentration of electrical stress and precluding any corona discharge between the encapsulation material and the metallic overcoating.

A feature of the preferred embodiment of the invention is the incorporation of a ceramic dielectric capacitor as the principal energy storage element. The use of a ceramic dielectric capacitor was found to be essential to the achievement of practically unlimited operating life for the described invention. During the course of normal operation and function, the energy storage capacitor is subjected to rates of electrical stress change of enormous magnitude, must deliver large pulses of current at very rapid rates, must contribute no significant inductance to the electrical circuit, must not unduly self-heat due to any of the power-loss mechanisms within the capacitor itself, and must not experience any significant change in its capacitive properties as a result of its operation for extended periods of time or at temperature extremes common to the application of the overall device. Investigation of many commercially available ceramic dielectric capacitors utilizing what is known as Class II ceramic dielectrics has shown them to be suitable for use in the present invention, particularly when evaluated for properties such as value, tolerance, temperature coefficient of capacitance, dissipation factor, direct current working voltage, direct current voltage coefficient of capacitance, alternating current working voltage, alternating current voltage coefficient of capacitance, frequency response, insulation resistance, effective series resistance, dielectric absorption, aging, quality factor, and immunity from damage or deterioration of any of these properties due to any internal corona discharge within the capacitor itself. It was discovered during the course of this evaluation that capacitors utilizing Class II ceramic dielectric materials will deliver significantly more energy than can be explained on the basis of their otherwise normally specified and measurable proporties. Ordinarily, a capacitor is only considered capable of delivering an energy, expressed in watt-seconds or joules, equal to one-half the product of its capacitance, expressed in farads, multiplied by the square of the voltage, expressed in volts, to which the capacitor is charged. This relationshp can be mathematically expressed as $Q=\frac{1}{2}CV^2$, where Q=the stored energy in watt-seconds or joules, C=the capacitance in farads, and V= the voltage across the plates of the capacitor in volts.

Since the width of pulses delivered by the present invention is significantly larger than can be explained by the $Q=\frac{1}{2}CV^2$ relationship, further investigation was undertaken to isolate the underlying cause. Comparisons between capacitors using Class I ceramic dielectrics and capacitors using Class II ceramic dielectrics of essentially identical electrical properties definitively demonstrate that the excess pulse width is peculiar to Class II ceramic dielectric capacitors. It was observed during the course of these comparisons that capacitors utilizing Class II ceramic dielectric materials produce readily audible sounds during their operation in the preferred embodiment of the present invention, whereas capacitors using Class I ceramic dielectric materials do not produce these readily audible sounds. This observation provided a clue that the source of the extra energy is a piezoelectric energy storage and delivery mechanism, exclusive of the subject capacitor's normal capacitive electrical energy storage mechanism. Illumination of operating capacitors with coherent light from a low-power laser vividly demonstrates the presence or absence of this piezoelectric (mechanical distortion due to electrical stress and electrical stress due to mechanical distortion). Capacitors with Class II ceramic dielectrics exhibit this piezoelectric effect and capacitors with Class I ceramic dielectrics do not. Furthermore, immersion of an operating Class II ceramic dielectric capacitor in commonly available viscoelastic damping materials eliminates or substantially reduces both the audible sounds and the additional pulse width energy. Again, Class I ceramic dielectric capacitors do not exhibit any change in their pulse energy characteristics when so immersed or encapsulated.

This phenomenon is fortuitous in the present invention since it permits a smaller and therefore less expensive capacitor to be used to achieve a given pulse width or the use of a nominal value capacitor to achieve an increased pulse width for the purpose of securing more vigorous and reliable ignition of the associated gaseous discharge lamp.

Another feature of the preferred embodiment of the invention is the incorporation of a transformer for the purposes of changing the voltage at which energy is stored in the aforementioned capacitor to the voltage required for ignition of the associated lamp, isolating the resultant high voltage from the ballast and its associated wiring, and also serving as an inductance for reducing radio frequency interference. In the preferred embodiment, this transformer is constructed as a single layer of suitable wire wound as a solenoid on a core of ferromagnetic material. In the course of the development of the preferred embodiment, it was found that suitable ferromagnetic materials for the core of this transformer are, in addition to their normal ferromagnetic properties somewhat resistive in their electrical properties. That is, their electrical characteristics are neither that of what is commonly considered a conductor nor that of what is commonly considered an insulator.

This resistive nature of the ferromagnetic core material is exploited in the preferred embodiment of this invention by making electrical connections between the core of the transformer and the ends of the transformer windings. This produces a voltage divider along the length of the transformer which maintains an evenly distributed electrical voltage stress between the core of the transformer and the winding of the transformer which is below the corona discharge inception threshold within the bulk of or upon the surface of any insulation on the wire of the transformer winding or transformer core. Some otherwise suitable ferromagnetic core materials were found to be of an excessively highly resistive nature, that is, their bulk electrical properties are too much on the order of an insulator for that aforementioned evenly divided distribution of electrical voltage stress between the core and winding to occur to the degree necessary for the elimination of corona discharge between the core and winding. For these materials, the core is evenly coated with a layer of material whose electrically resistive properties are such that the same effect of evenly distributing the electrical stress between the transformer coil and the core is achieved.

Furthermore, some otherwise suitable ferromagnetic materials were found to be of an excessively highly conductive nature, that is, their bulk electrical properties are too much on the order of a conductor. To permit the use of these materials, the core is coated with an impervious and pinhole-free layer of an insulating material, including the ends of the core, which is thus insulated. This insulating coating is further coated with a layer of a material whose electrically resistive properties are such that the same effect of evenly distributing the electrical stress between the windings of the transformer coil and this resistive coating, rather than the core, is achieved. Since for this case, the resistive coating completely surrounds the ferrogmagnetic core and is insulated from it by an impervious insulating material, there is no significant electrical stress between the core and the coating, in accordance with Faraday's Law that changes reside on the outside of a conductor, said conductor being the resistive coating. For all three bulk resistivity situations of suitable ferromagnetic core materials, electrical connections are made from the ends of the transformer winding to the core of the transformer itself or one or more coatings on the surface of said core, for the purpose of evenly distributing any electrical stress, this even distribution of electrical stress resulting in the elimination of any concentrated electrical stress and reducing the electrical stress between adjacent surfaces to levels below the inception voltage of any corona discharge.

DESCRIPTION OF THE PREFERRED EMBODIMENT

Figure 1:
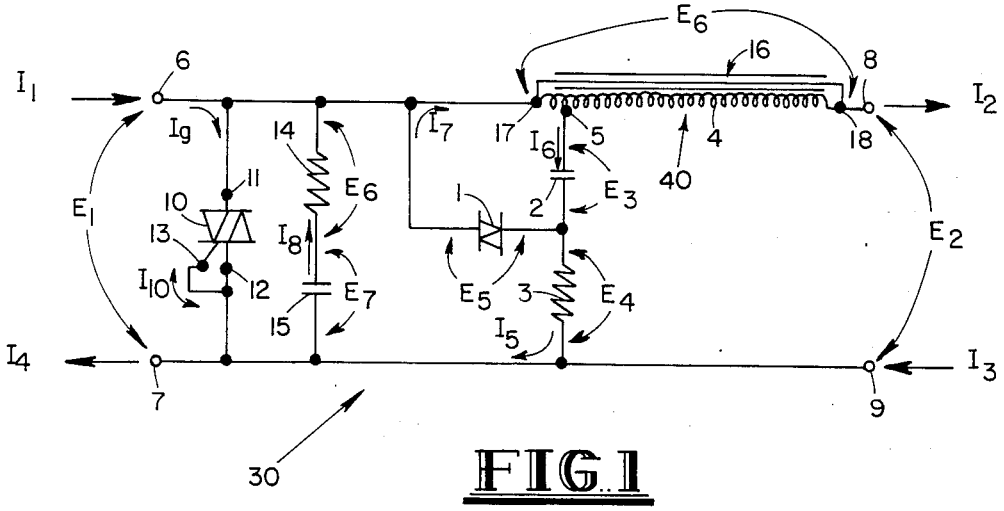
FIG. 1 is an electrical schematic of the invention.
Figure 2:
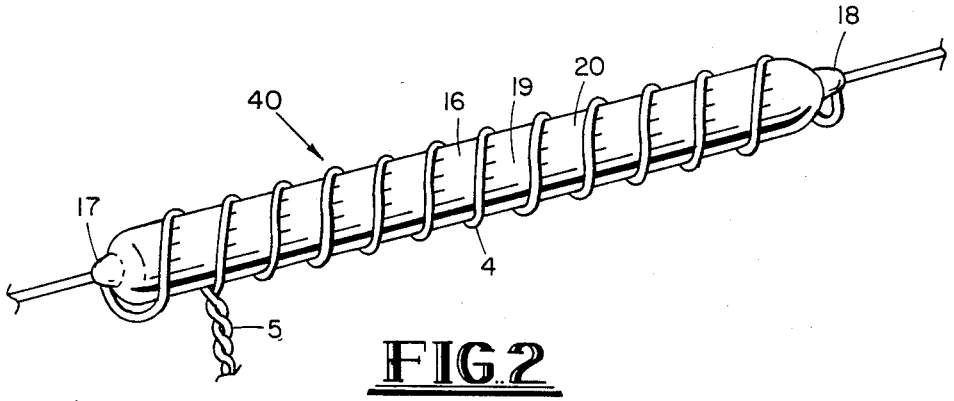
FIG. 2 is an oblique view illustrating the transformer included as part of the invention.
Figure 3F:
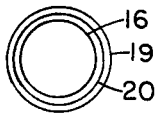
Figure 4:
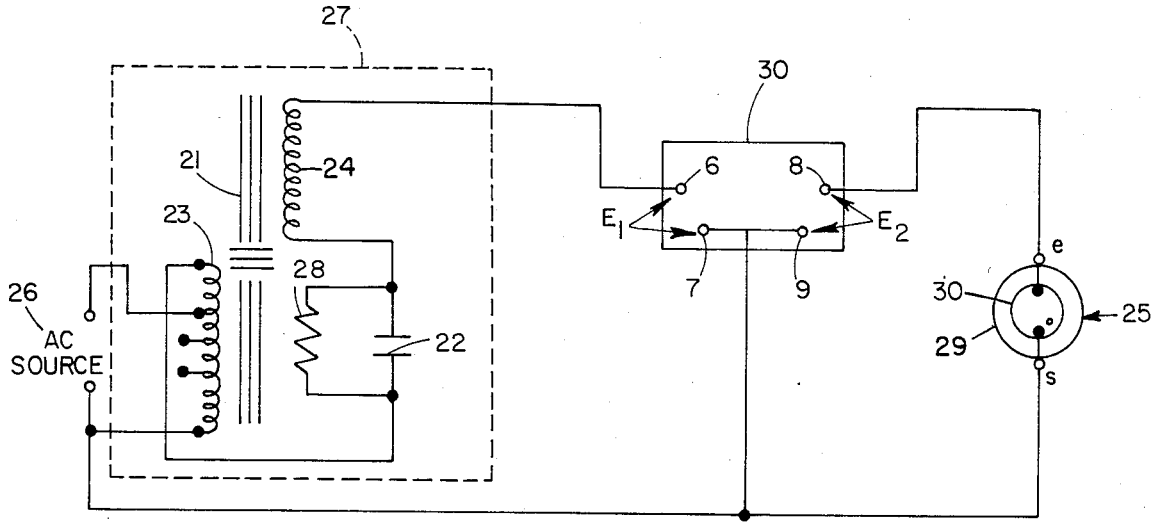
FIG. 4 is an electrical schematic showing a representative use of the invention.

Now referring to the drawings and first to FIG. 1, a combined ignitor and transient suppressor 30 is shown which includes a bidirectional voltage sensitive breakover device 1, a capacitor 2, a resistor 3, a transformer 40, a second bidirectional voltage sensitive breakover device 10, a second resistor 14, and a second capacitor 15. In a typical application, such as FIG. 4, a ballasting apparatus 27 is connected to a source of alternating current power 26 and to the invention 30 by means of terminals 6 and 7 as can be seen in FIG. 4. Also, in the typical application of FIG. 4, a gaseous discharge lamp 25 is connected to the invention 30 by means of terminals 8 and 9. FIG. 2 shows an oblique view of the transformer 40 which includes winding 4, core 16, one or more coatings 19 and 20 (see FIG. 3*f*), with a tap 5 on winding 4 near one end thereof, and electrical connections to core 16 or its outermost layer 19 at the ends 17 and 18 of core 16, which ends 17 and 18 are also the ends of the winding 4. Tap 5 of winding 4 may be positioned anywhere along winding 4, as dictated by the requirements of the application of the invention.

Figure 5A:
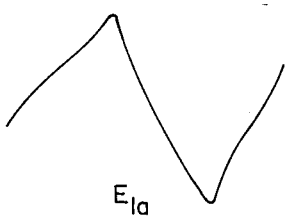
FIGS. 5*a*, 5*b*, and 5*c* are several electric voltage and current waveforms pertinent to the operation ot the invention.
Figure 5B:
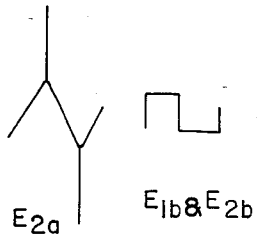
Figure 5C:
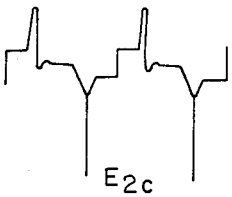
Figure 6:
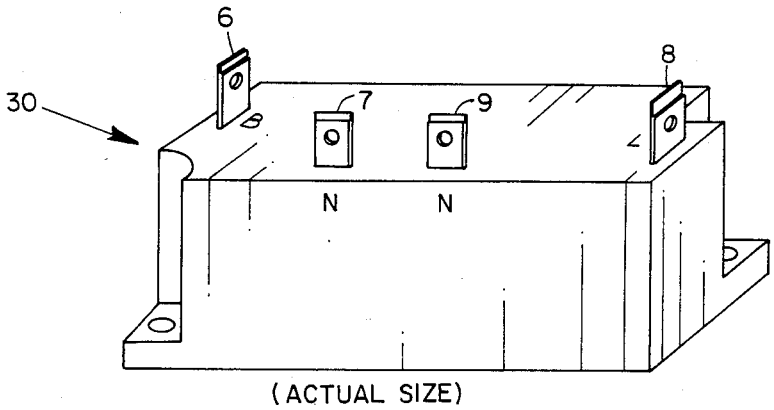
FIG. 6 is an oblique view of an embodiment of the invention after encapsulation.

Operation of the circuit can be more clearly understood by referring to FIGS. 1, 4, and 5 in combination. E1 is the voltage waveform typically presented by ballast 27 when it is energized by AC power source 26 to terminals 6 and 7 of the invention. In the same FIGS. 1, 4, and 5, E2*a* is, at a somewhat different scale, the voltage that is applied to gaseous discharge lamp 25 from the invention by means of terminals 8 and 9, before conduction has been initiated through gaseous discharge lamp 25. Also in the same FIGS. 1, 4, and 5, the voltage waveforms labeled E1*b* and E2*b* are at the same scale as voltage waveform E2*a* and are the voltages across terminals 6 and 7 and terminals 8 and 9 of the invention. Voltage waveforms E1*b*, and E2*b* represented in FIG. 5 as having for all practical purposes the same magnitude and shape, and are representative of the voltages present after conduction has been initiated in the gaseous discharge lamp 25.

The voltage designated E1 in the drawings is when gaseous discharge lamp 25 is not conducting and is commonly referred to as the open circuit voltage (OCV) of the ballast. Voltage E1 is the typical voltage waveform designated as E1*a* in FIG. 5. The voltage designated E2 in the drawings is when gaseous discharge lamp 25 is not conducting and has the same shape and magnitude as E1*a* with the addition of one or more sharply rising high voltage spikes at or near the maximum positive and negative excursions of E1*a*. Due to the facts that these starter or ignitor pulses are applied in series with the voltage at terminals 6 and 7 and are furthermore short-circuited by the snubber network comprised of resistor 14 and capacitor 15, the starter pulses are added to E1, appear across terminals 8 and 9, represented as waveform E2*b* in FIG. 5, and do not appear to any substantial degree across terminals 6 and 7. The E2*b* voltage waveform is applied to eyelet "e" and shell "s" terminals of the typical gaseous discharge lamp 25.

Once conduction has been initiated through gaseous discharge lamp 25, the gaseous discharge lamp 25 acts as a shunt voltage regulator clamping the voltage across terminals 8 and 9 to what is commonly referred to as the normal burning voltage ("NBV") or normal operating voltage ("NOV") that is characteristic of the particular gaseous discharge lamp 25. Since the NBV or NOV of the gaseous discharge lamp 25 is considerably smaller than the OCV of the ballast, this variation provides a simple means of terminating the operation of the ignitor portion of the circuit by simply using a voltage sensitive bidirectional breakover device 1 whose electrical breakover characteristics are such that the OCV, as divided by capacitor 2 and resistor 3, will develop sufficient voltage across capacitor 2 to initiate the conduction of breakover device 1. The breakover device 1 is effectively connected across capacitor 2 by means of winding 4 and tap 5 of the transformer on one end of device 1 and the electrical connection to capacitor 2 on the other end of device 1.

It is characteristic of the bidirectional breakover device 1 that it will exhibit essentially no conduction until the voltage across its two end terminals, represented by E5 in FIG. 1, exceeds a certain voltage commonly referred to as the switching voltage or breakover voltage and usually abbreviated "Es." Once E5 is equal to Es, the device 1 breaks over into a heavy conduction mode and exhibits a very low voltage drop while conducting a relatively large current, designated as I7 in FIG. 1. This current I7 results from the charge stored in capacitor 2 by the current I6 flowing as a result of E1 being applied to the series connected capacitor 2 and resistor 3. When the voltage across capacitor 2, represented by E3 in FIG. 1 is equal to Es of device 1, conduction I7 is initiated through the loop comprised of device 1, capacitor 2, and the tapped portion of transformer winding 4 formed by tap 5 and end connection 17.

Once conduction through this loop has been initiated, it will build up at a rate that is essentially limited only by the inductance present in the portion of winding 4 represented by tap 5 and end connection 17. This current will eventually reach a peak, determined primarily by the capacitance of capacitor 2 and then begin to decay until it reaches a rather low value determined by the characteristic of device 1 commonly referred to as the holding current of device 1. At that time conduction through the device 1, capacitor 2, transformer winding 4, tap 5, and end connection 17 will abruptly cease. Any residual energy remaining stored in the inductance of transformer winding 4 will be effectively absorbed, or snubbed, by the snubbing network comprised of resistor 14 and capacitor 15 as well as the energy storage network comprised of capacitor 2 and resistor 3. Transformer winding 4 serves to increase the voltage developed across end connections 17 and 18 as a result of the voltage developed across tap 5 and end connection 17 by the discharge of capacitor 2 through this portion of winding 4 by the action of bidirectional switching device 1. The turns ratio of tap 5 to winding 4 is determined by the ratio of the E3 voltage developed across capacitor 2 (this being the breakover voltage of device 1) to the peak voltage of E2 required by the gaseous discharge lamp 25.

As a numerical example, which is presented for illustrative purposes only, a common ballast for use with a 400 watt high pressure sodium ("HPS") gaseous discharge lamp will typically exhibit an OCV (E1*a* in FIG. 5) of about 250 volts peak. While the 400 watt HPS lamp will exhibit a normal operating voltage of approximately 100 volts, it will also require an ignitor or starter pulse of approximately 3,000 volts with a maximum allowable peak voltage of 3,500 volts, as well as a pulse width of not less than one microsecond as measured at a pulse height of 2,500 volts. These available and required values of voltages permit the use of a bidirectional breakover device 1 with a nominal Es of 210 volts, a capacitor 2 of a nominal value of 0.15 microfarad, and a resistor 3 of a nominal value of 6,000 ohms. For this example case, transformer winding 4 would then consist of 35 turns of wire with tap 5 brought out two turns up from end connection 17. The open circuit voltage E1*a* will develop approximately 225 volts (E3) across capacitor 2. The remaining 25 volts will appear as E4 across resistor 3. E3 and E4 voltages will reach these levels only in the absence of device 1 since in this example device 1 will switch to its conducting state when E3=210 volts, the breakover voltage of device 1. With device 1 in the circuit, capacitor 2 will be discharged into the bottom two turns of winding 4 via end connection 17 and tap 5, when E3 reaches 210 volts, producing a per turn voltage in winding 4 of approximately 105 volts per turn. If all of the components were perfect and ideal components without any power losses, the voltage across the end terminals 17 and 18 of the transformer 40 would thus be 35×105 volts, or 3675 volts. As it always is with any real device, however, power losses in the device 1, capacitor 2, and transformer 40 result in an actual voltage of approximately 3,500 volts being developed across end terminals 17 and 18 of transformer winding 4. This meets the maximum allowable starter pulse voltage specificiation of the example 400 watt HPS lamp, as well as exceeds the minimum starter pulse voltage specification for the example 400 watt HPS lamp. The pulse width specification requirement is met by using an appropriately rated capacitor 2. A larger capacitance more or less directly yields a proportionately wider pulse width at the specified measurement level. A larger capacitance value for capacitor 2 does, of course, require a lower resistance value for resistor 3 in order that the same nominal voltage division ratio for E3 and E4 is maintained.

That portion of the rapidly rising pulse voltage waveform present at end terminal 17 is shunted to terminals 7 and 9 by the snubber network comprised of resistor 14 and capacitor 15. In the given example of the 400 watt HPS application, values of 10 ohms for resistor 14 and 0.15 microfarad for capacitor 15 have been found suitable. However, other values for either component also being obviously workable. This snubber network effectively prevents large, rapidly changing voltages from appearing across terminals 6 and 7 of the invention and thus the ballast apparatus connected to terminals 6 and 7. This effectively limits the magnitude and rate-of-rise of voltages impressed on the ballast by the presence of the starter pulses, an effect of considerable benefit since ordinarily, the high voltages and rapid rate-of-rise due to the starter pulses exceed the corona inception thresholds of various insulating materials used in the construction of a typical ballast and its associated wiring. This corona discharge is a prime offender in the typical unnecessarily short operating lifetime of many gaseous discharge lighting systems, since over time it will attack and destroy the insulation of the ballast and associated wiring.

In FIG. 1, device 10 is a bidirectional thyristor device, also known as a triac, having three electrically connected terminals. These terminals are referred to as 12 (main terminal one), 11 (main terminal two), and 13 (the gate or trigger electrode). In the preferred embodiment, main terminal one and the gate (12 and 13 in FIG. 1) are connected together. When thus conected, any residual voltages which are not shunted around terminals 6 and 7 of the invention by the action of resistor 14 and capacitor 15, and thus terminals 11 and 12 of device 10, are shunted out of the gate terminal 13 of device 10, preventing turn-on of device 10 by the normal operation of the ignitor portion of the invention.

Referring to FIG. 4, it can be readily seen that once a current is flowing in the circuit comprised of AC source 26, ballast primary winding 23, ballast capacitor 22 and its bleeder resistor 23, ballast secondary winding 24, the terminals 6 and 8 of the invention 30, and lamp 25 terminals e and s, this current will tend to continue to flow if the circuit is interrupted at any point. It can further be seen that the ballast secondary 24 is principally performing the function of an inductor. In actual application of the example 400 watt HSP lighting system, these interruptions of current flow occur from three principal causes.

The first principal cause is when the normal AC power source 26 is shut OFF. The collapsing magnetic fields of ballast primary 23 and ballast secondary 24 produce large voltages across these windings. Since the circuit is completed in this instance by lamp 25, considerable voltages will be developed across capacitor 22 and resistor 28 as well. Resistor 28 is normally employed to discharge capacitor 22 in some conveniently small time, on the order of several seconds. The voltage which suddenly appears across capacitor 22 upon the interruption of AC power source 26 due to the inductive action of ballast primary 23 and ballast secondary 24 is quite frequently well beyond what can be safely tolerated by resistor 28, which initially fails as a short circuit, or at least as a comparatively low resistance. When AC power source 26 is restored, resistor 28 continues to fail as a short circuit for a small amount of time, then typically ignites, burns itself out, and ultimately fails as an open circuit. When resistor 28 has thusly failed, it obviously cannot perform its function of bleeding any residual charge from capacitor 22. Quite frequently, this results in the destruction of capacitor 22.

If the DC voltage produced across capacitor 22 and resistor 28 upon interruption of AC power source exceeds the main terminal breakover voltage of triac device 10, triac device 10 will rapidly switch from an essentially open circuit to an essentially short circuit. When this occurs, the charge on the plates of capacitor 22 is rapidly removed, the current being limited in both rate of rise and magnitude to values which can easily be withstood by triac device 10 by the inductance of ballast 27, both in primary 23 and secondary 24 windings.

Device 10, normally a triac or bidirectional thyristor, is selected such that its main terminal breakover voltage characteristic is above the normal operating voltage which will appear across terminals 6 and 7 of the invention, terminals 11 and 12 of device 10 being connected to them as illustrated in FIG. 1. Device 10 is further selected such that its main terminal breakover voltage is below the voltage at which any damage to capacitor 22 or resistor 28 would occur. Thus, device 10 will not normally conduct any current until called upon to do so by the appearance of excessively high voltages across device 10, at which time device 10 will switch to its conductive state for the purpose of removing any excessively high voltage from capacitor 22. Any energy which may have been stored in the inductance of primary and secondary windings 23 and 24 of ballast 27 is also removed and dissipated. Once the charge stored in capacitor 22 and the energy stored in ballast 27 have been removed by the switching action of device 10 and dissipated, device 10 will automatically revert to its normal non-conducting state.

In addition to selecting device 10 such that its main terminal breakover voltage is above the normal operating voltage of the circuit and below the failure voltage of the various components of the circuit, device 10 must also be capable of conducting the currents to which it will be subjected when it does switch to its conductive state, without damage to itself or any significant change in its electrical characteristics. Device 10 must also be selected such that it will not switch into its conducting state when subjected to the residual voltages developed across the series circuit comprised of resistor 14 and capacitor 15 during normal operation of the ignitor circuit portion of the invention.

Although shown in FIG. 1 and explained and referred to as a triac or bidirectional thyristor, devive 10 can obviously take many forms as required by the particular application of the invention, such as a single silicon controlled rectifier or reverse blocking thyristor, a pair of inversely connected silicon controlled rectifiers, or other forms as will be apparent to anyone skilled in the art.

The second principal cause of interruptions of current flow is the physical loosening of lamp 25 in its socket due to vibration, temperature cycling, or other causes. Similarly, the mechanical parts used to make electrical connections to lamp 25 frequently become loose for the same reasons. When any of these loose connections occur, the ballast 27 will attempt to sustain the resultant electrical arc since it is designed to sustain an electrical arc within lamp 25 and has no means of determining that the arc it is sustaining is actually, for example, either at the eyelet terminal "e" of lamp 25, the shell terminal "s" of lamp 25, or wherever the arc may actually exist.

It is characteristic of these loose connection arcs that they very often will not conduct a current of one polarity of applied voltage as easily as a current of the other polarity of applied voltage. This behavior is often referred to as a rectifying arc since it has the electrical characteristics of a diode. This diode behavior of the rectifying arc produces an asymmetrical flow of current in the ballast circuit and due to this, causes magnetic saturation of the ballast core 21, reducing the inductance of ballast winding 24 and thus increasing the asymmetrical current flow. This not only increases the flow of current through the rectifying arc, it also causes the arc to be more of a rectifier, further intensifying the effect. since the ballast secondary 24 rapidly becomes saturated, it can no longer control the flow of current to any appreciable degree. The current will increase very rapidly and as a result, frequently destroys lamp 25. Furthermore, due to the diode nature of the rectifying arc, prodigious direct current or DC voltages will build up across capacitor 22 and resistor 28, either or both of which fail catastrophically.

Referring to FIGS. 1 and 4, it can be seen that triac device 10 is connected from terminals 6 and 7 of the invention, and thus across the series circuit comprised of ballast primary 23, capacitor 22 shunted by resistor 28, and ballast secondary 24. It is noteworthy that primary and secondary windings 23 and 24 of ballast 27 have no appreciable DC resistance. Thus, any DC current flow produced by rectifying arc will cause a DC voltage to build up across capacitor 22 and its shunt connected bleeder resistor 28. Under these conditions, this DC voltage will continue to build up until it reaches the main terminal breakover voltage characteristic of the device used for triac 10. When this occurs, device 10 becomes a conductor of low voltage drop producing essentially a short across capacitor 22 and thus discharging the potentially destructive DC voltage built-up across it by the rectifying arc. The inductance and DC resistances normally present from the wire used to wind primary and secondary windings 23 and 24 of ballast 27 serve to limit the rate of rise and magnitude of the current under these conditions to levels which can be safely withstood by triac device 10. Once device 10 has switched into its conducting state, the voltage which was sustaining the arc is shunted by the low voltage drop of device 10, thus extinguishing the arc.

Current will continue to flow through device 10 until such time as the AC power source 26 has reversed its polarity and the current through device 10 has decreased to below the holding current required for device 10. At that time device 10 will revert to its normal non-conducting state. The voltage across terminals 11 and 12 of device 10 will rise at a rate determined by the characteristics of the ballast 27 operating in conjunction with the snubber network comprised of resistor 14 and capacitor 15. The snubber network serves to limit the rate of rise of the commutating voltage across device 10 to less than the critical rate of rise of device 10, thus preventing turn-on of device 10 until the voltage across terminals 11 and 12 again exeeds the main terminal breakover voltage characteristic of device 10. The connection from terminal 12 of device 10 to terminal 13 of device 10 (commonly referred to as main terminal one and the gate, respectively) further assists this snubbing action by providing a path for current I10 in FIG. 1, which effectively prevents any current flow between the gate and main terminal one within the bulk of device 10. Current I10 is the result of small but unavoidable capacitance between the electrodes of device 10, principally electrode 11, and main terminal two and electrodes 12 and 13, main terminal one and gate, respectively. Device 10 thus is not turned ON by the so-called commutating dv/dt.

In the event that an arc between normally current-carrying parts does not degenerate into a rectifying arc, it will nonetheless cause the initiation of conduction by device 10 through the mechanism of rate of change of applied voltage to turn-ON of device 10. This is due to relatively rapid changes in the current which occur due to the arcing contacts. Thus, large voltages of a sharply rising characteristic due to the inductance of the primary winding 23 and secondary winding 24 of ballast 27 are produced and serve to turn ON device 10, which then removes the source voltage which produced the arc in the first place, continues to conduct for the remaining portion of the half-cycle during which the arc occurred, and reverts to its normally non-conducting state until the arc occurs again.

The third principal cause of interruptions of current flow, and by far the most dangerous and destructive rapid changes in the current flowing in the secondary circuit of the typical ballast, happen when a disconnection within the vacuum envelope of lamp 25 occurs. In FIG. 4, this would be between the terminals marked "e" or "s", for eyelet or shell, of lamp 25 and its inner arc tube envelope 30. Due to the high degree of vacuum within outer envelope 29 and the refractory nature of the metals used to physically realize the electrical connections to the inner arc tube envelope 30, a physical break frequently occurs producing a total interruption of the current flow within the arc tube in less than one microsecond. As outlined in the background of this invention, prodigious voltages will occur at this time due to the collapse of the magnetic fields within the inductance of ballast 27. Unless an alternative pathway for the current is provided, the voltage will rise until a pathway is created. This frequently translates to destruction of the ballast 27, the capacitor 22, resistor 28, lamp 25, wiring between the various portions of the circuit, or many other possible failures.

Device 10 will be pulsed in its conducting state almost instantly, however, due to the rapid rise of voltage and/or the levels to which the voltage actually rises to, when device 10 switches to its conduction state, it effectively short circuits these destructive voltages and provides a path by which the current can continue to flow without harm to itself or any other components. Since device 10 is deliberately selected to turn ON at voltages which are less than any levels which would be destructive to other components as well as to be large enough to safely conduct the full available current under the conditions of main terminal breakover or rate of change of principal voltage induced conduction initiation by device 10, destruction of the device 10 has been avoided.

The resistor 14 and capacitor 15 form a snubber network that acts to shunt the starter pulse in the winding 4 of the transformer 40. Also resistor 14 and capacitor 15, once that conduction has been started through the lamp 25, will discharge through the lamp 25 to give a much wider starting pulse. The wider starting pulse insures that the lamp 25 will ignite and light with the first pulse producing current flow therethrough. Also the resistor 14 and capacitor 15 provide protection for transient conditions, such as a loose connection or a loose lamp 25. This is very important to prevent damage either to the lamp 25 or to the ballast 27. Lastly, the resistor 14 and capacitor 15 limit the rate of change of voltage across the triac 10.

The triac 10 is a bidirectional breakover device that conducts if a voltage (positive or negative) is developed thereacross which exceeds its breakover voltage. The triac 10 may conduct during either half-cycle, but would cut OFF once the current reaches zero and would not begin conducting again until its breakover voltage had been exceeded. A typical breakover voltage for this type of circuit would be approximately 450 volts. The triac 10 gets rid of the voltage or energy stored in capacitor 22 or secondary winding 24 of the ballast 27. This is particularly true when something is not working properly, such as a loose lamp 25.

The ballast 27 may be of any particular type of ballast, however, it is envisioned that the present invention would be used with a regulating ballast, a high reactance auto transformer type of ballast, or a reactor ballast.

The breakover device 1, capacitor 2, and resistor 3 basically form a voltage trigger relaxation oscillator. When the voltage E5 across the breakover device 1 has been exceeded, the breakover device 1 will begin to conduct through the end 17 of winding 4 and tap 5. This will cause a large voltage to be developed across the lamp 25. This type of triggering current formed by the conduction of breakover device 1 occurs every half cycle until the lamp 25 is lit and conducting. After the lamp 25 is lit and conducting, breakover device 1 will not operate again until lighting of the lamp 25 is called for by the circuit. The breakover device 1 would traditionally be a solid state device referred to as a sidac.

Figure 3A:
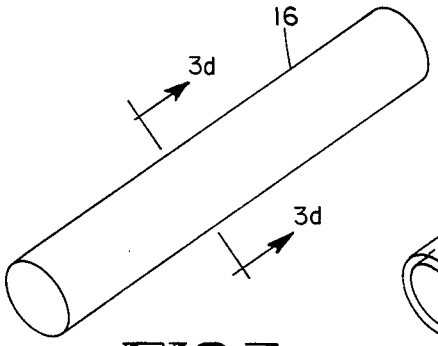
FIGS. 3*a*, 3*b*, 3*c*, 3*d*, 3*e*, and 3*f* are oblique and sectional views of the core of the transformer illustrated in FIG. 2, showing details of construction for various core materials.
Figure 3B:
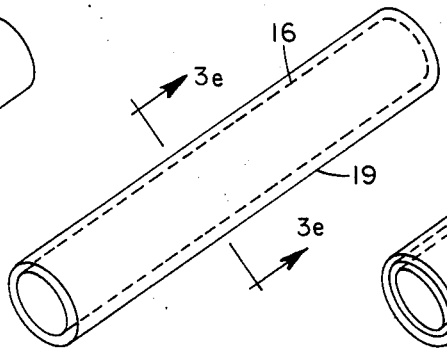
Figure 3C:
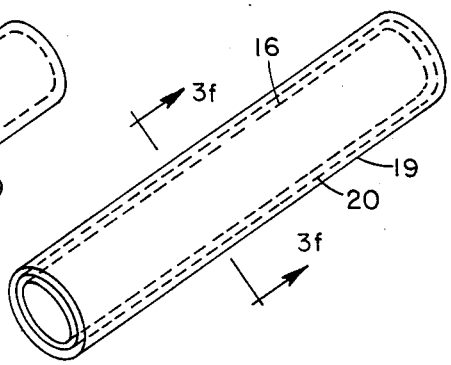
Figure 3D:
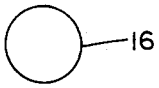
Figure 3E:
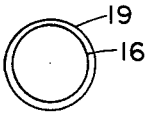

The transformer formed by winding 4 and core 16 has to have a core that will withstand the stresses that may be applied to the device. Referring to FIGS. 2 and 3, it can be seen that the core 16 may have a resistive conductive coating 19 as shown in FIGS. 3*c* and 3*f*. Since the core 16 may be made from many different types of material, the object is to have a core that has certain resistive characteristics. In the design of the core 16, it should have between 20,000 and 100,000 ohms resistance thereacross. In FIG. 3*f*, to increase the resistive characteristics, an insulating coating 20 is first applied to the core 16 and thereafter a resistive conductive coating 19 is applied to the core 16. This provides for an even distribution of stress across the entire transformer 40 to help eliminate the corona effect. Also the ends of the winding 4 are connected to the ends of the core 16 as shown by connections 17 and 18. This connection can be made by any particular means, such as a conductive epoxy.

It has been found that if either capacitor 15 or capacitor 2 are made from a ceramic dielectric material, they work much better in the present invention. The Electronic Industries Association defines a type of capacitor referred to as Class II capacitors that are made from ceramic dielectric material. These Class II capacitors have piezoelectric characteristics and store electrical energy in mechanical form. By use of Class II capacitors, it has been found that the capacitor appears much larger than it actually is. Capacitors may have a rating of 20–30% lower if they are the Class II type that have the piezoelectric characteristics. This allows for a much more economical capacitor to be used, which capacitor is likewise much more reliable.

The breakover device 1 (sidac) will have a voltage rating that will depend upon the type of lamp 25 being lit. In a typical configuration, the breakover device 1 would have a 220 volt rating.

While any particular type gaseous discharge lamp 25 may be used, a sodium discharge lamp probably has as rugged of characteristics as have to be met for gaseous discharge lamps. Therefore, the present invention will work on any type of gaseous discharge lamp, but is designed to work under the rugged characteristics of a sodium discharge lamp 25.

I claim:

1. An ignitor and transient suppressor for connection between a gaseous discharge lamp and a ballast for receiving an AC voltage thereto to light said gaseous discharge lamp, said ignitor and transient suppressor comprising:

transformer means having a connecting means at first and second ends thereof with a tap near said first end thereof, said second end of said transformer means being adapted for connection to a first side of said gaseous discharge lamp;

voltage triggered relaxation oscillator connected across said first end of said transformer means and said tap of said transformer means, said voltage triggered relaxation oscillator also being adapted for connection to a second side of said gaseous discharge lamp, said voltage triggered relaxation oscillator triggering for conduction during every half-cycle of said AC voltage until said gaseous discharge lamp is lit;

bidirectional breakover device connected by a first terminal to said first end of said transformer means and adapted to be connected by a second terminal to said second side of said gaseous discharge lamp, said bidirectional breakover device also adapted for connection across said ballast, said bidirectional breakover device conducting if voltage thereacross exceeds a predetermined voltage to reduce harmful voltage transients as may originate in said ballast; and snubber means directly connected across said bidirectional breakover device for protection against said harmful voltage transients, said snubber means shunting starter pulses from said transformer means and also discharging during starting through said lamp said snubber means being appropriately sized to reduce rate of rise of said harmful voltage transients so that said bidirectional breakover device can respond to and handle said harmful voltage transients without damaging said igniter and transient suppressor.

2. The ignitor and transient suppressor as recited in claim 1 wherein said transformer means is an auto transformer with a winding and a core, said connecting means at said first and second ends of said transformer means includes electrically connecting each end of said winding to a same end of said core.

3. The ignitor and transient suppressor as recited in claim 2 wherein said transformer means includes at least one coating to control resistive characteristics of said core to between a predetermined range.

4. The ignitor and transient suppressor as recited in claim 3 wherein said core has a first coating of insulating material and a second coating of resistive conductor material to provide even stress distribution across said entire transformer means by said control resistive characteristics.

5. The ignitor and transient suppressor as recited in claim 1 wherein said snubber means includes a first resistor and a first capacitor in series, said snubber means controlling rate of voltage change by said bidirectional breakover device.

6. The ignitor and transient suppressor as recited in claim 1 wherein said voltage triggered relaxation oscillator includes a voltage breakover triggering device connected between a second resistor and a second capacitor in series connection to said tap of said transformer means.

7. The ignitor and transient suppressor as recited in claim 5 or 6 wherein said first capacitor and said second capacitor are ceramic dielectric capacitors having piezoelectric characteristics to store electrical energy in a mechanical form.

8. The ignitor and transient suppressor as recited in claim 6 wherein said voltage breakover triggering device is a sidac.

9. The ignitor and transient suppressor as recited in claim 1 wherein said bidirectional breakover device is a triac.

10. A method of igniting and suppressing transients in a circuit for a gaseous discharge lamp, said circuit including a ballast receiving an AC voltage thereto and connecting through a control device to said gaseous discharge lamp, said method including the following steps:

stepping up a ballast voltage received from said ballast by transformer means in said control device;

triggering a relaxation device in said control device if said ballast voltage exceeds a first predetermined amount during every half-cycle of said AC voltage until said gaseous discharge lamp is lit;

breaking down a bidirectional breakover device in said control device connected across said ballast if said ballast voltage exceeds a second predetermined amount to allow conduction therethrough during any half-cycle of said AC voltage to reduce harmful transients in said ballast voltage; and snubbing said ballast voltage by a snubber network in said control device directly connected across said bidirectional breakover device to limit rate of voltage change in said bidirectional breakover device, said snubber network also discharging through said lamp to give a longer starting pulse said snubber network being appropriately sized to reduce rate of rise of said harmful voltage transients so that said bidirectional breakover device can respond to and handle and said harmful voltage transients without damaging said circuit.

11. The method of igniting and suppressing as recited in claim 10 wherein said snubbing step also includes shunting starter pulses in said transformer means and protecting against transient conditions if there is a failure such as a loose connection.

12. The method of igniting and suppressing as recited in claim 11 wherein said snubbing step and said triggering step includes converting electrical energy to mechanical energy and vice versa by use of ceramic dielectric capacitors having piezoelectric characteristics thereby allowing smaller size capacitors to be used.

13. The method of igniting and suppressing as recited in claim 10 wherein said stepping up step includes a winding and core forming said transformer means, another step including connecting each end of said winding to the same end of said core.

14. The method of igniting and suppressing as recited in claim 13 including a further step of precoatng said core to control resistive characteristics of said core between predetermined values.

* * * * *